United States Patent [19]

D'Amore, Jr.

[11] Patent Number: 4,998,330

[45] Date of Patent: Mar. 12, 1991

[54] JEWELRY CLOSURE DEVICE

[76] Inventor: William M. D'Amore, Jr., 37 Carlson Cir., West Warwick, R.I. 02893

[21] Appl. No.: 506,709

[22] Filed: Apr. 9, 1990

[51] Int. Cl.[5] ..... A44B 11/00

[52] U.S. Cl. ..... 24/700; 24/116 A; 24/701

[58] Field of Search ..... 24/700, 701, 310, 662, 24/616, 617, 116 A

[56] References Cited

U.S. PATENT DOCUMENTS

| | | | |
|---|---|---|---|
| 418,688 | 1/1890 | Converse | 24/701 |
| 657,683 | 9/1900 | Swearingen | 24/701 |
| 1,851,730 | 3/1932 | Rutherford | 24/700 |
| 2,233,071 | 2/1941 | Bangs | 24/201 |
| 2,346,887 | 4/1944 | Winkler | 24/201 |
| 2,446,018 | 7/1948 | Miskimen | 24/701 |
| 2,737,046 | 3/1956 | Jancsics | 24/116 A |

FOREIGN PATENT DOCUMENTS

| | | | |
|---|---|---|---|
| 819798 | 9/1959 | United Kingdom | 24/700 |

*Primary Examiner*—Victor N. Sakran

*Attorney, Agent, or Firm*—Salter & Michaelson

[57] ABSTRACT

A jewelry closure device includes an outer element and a central element which are adapted to be assembled to form a pendant-like structure. The outer element includes a frame portion having a central aperture of noncircular configuration therein and the central element includes a body portion and a peripheral rim portion on the body portion. The body portion is of substantially the same dimension and configuration as the aperture in the frame portion and the body and rim portions are receivable through the aperture in the frame portion from the rear side thereof in order to position the body portion in a substantially aligned assembled position in the aperture wherein the rim portion engages the frame portion to prevent rearward movement of the body and rim portions through the aperture.

5 Claims, 1 Drawing Sheet

JEWELRY CLOSURE DEVICE

BACKGROUND AND SUMMARY OF THE INVENTION

The instant invention relates to ornamental jewelry and more particularly to a closure device which is adapted for use as a jewelry pendant.

While a wide variety of different types of closure devices have been heretofore available for use in connection with various jewelry items, such as necklaces, bracelets, and other chain-like jewelry items, most of the previously known closure devices have included clasp or hook type elements which have not been readily adapted for ornamental constructions. As a result, most of the heretofore available jewelry closure devices have been made in miniaturized constructions so that they are as inconspicuous as possible during use.

The instant invention provides an effective closure device which is adapted to be assembled to form a jewelry pendant and which can be effectively embodied in a wide variety of attractive ornamental configurations. Specifically, the closure device of the instant invention comprises an outer element which includes a frame portion having a central aperture of noncircular configuration therein and a central element which is adapted to be received in assembled relation with the outer element so that it cooperates therewith to define a pendant. The central element includes a body portion having a dimension and a configuration which are substantially the same as the dimension and configuration of the aperture in the outer element and a rim portion which projects outwardly from the peripheral edge of the body portion adjacent the front side thereof. The aperture in the frame portion and the body portion of the central element are dimensioned and configured so that the central element can be passed forwardly through the aperture in the frame portion from the rear side thereof and so that the central element can then be assembled in an aligned position in the aperture with the rim portion of the central element engaging the front side of the frame portion to prevent the central element from passing rearwardly through the aperture. The rim portion preferably extends substantially entirely around the perimeter of the body portion. Further, the frame portion preferably has an outwardly extending slot formed in the rear side thereof and the central element preferably includes a leg portion which is receivable in the slot in the frame portion in order to further retain the central element in assembled relation with the outer element. Still further, the central element preferably includes an engagement member on the leg portion thereof which is engageable with the peripheral edge of the frame portion to further retain the central element in assembled relation with the main element.

It has been found that the closure device of the instant invention can be effectively embodied in a wide variety of attractive configurations to provide an ornamental pendant. In this regard, the central element is receivable in the frame portion of the outer element so that the front side of the frame portion and the front side of the central element cooperate to define an outwardly facing front face on the pendant. Further, when the central element is assembled with the outer element in this manner, the central element and the outer element have the appearance of a single one-piece jewelry pendant which is not adapted to be disassembled. Still further, when the central element is constructed so that it includes a leg on the rear side thereof which is receivable in a slot in the rear side of the frame portion and so that it further includes an engagement member which is engagable with the peripheral edge of the frame portion, the central element is adapted to be effectively and positively retained in assembled relation so that it is highly resistant to being inadvertently disassembled. Still further, because the closure device of the instant invention is adapted to be embodied as a jewelry pendant, the outer element and the central element can be assembled on opposite ends of a chain-like jewelry item and a further clasp or closure device for the jewelry item is unnecessary.

Devices representing the closest prior art to the subject invention of which the applicant is aware are disclosed in the Bangs, U.S. Pat. No. 2,233,071 and Winkler, U.S. Pat. No. 2,346,887. However, while these references are broadly suggestive of the concept of forming a jewelry closure device from first and second elements which are receivable in interfitting engagement without the use of latch or hook type elements, they fail to suggest a closure device which is adapted to be readily and easily assembled and disassembled in the manner of the closure device of the subject invention. They also clearly fail to suggest a closure device which includes a central element having a peripheral rim portion which is engagable with the front side of a frame portion in the manner of the closure device of the instant invention and as a result, the above references are believed to be of only general interest with respect to the subject invention.

Accordingly, it is a primary object of the instant invention to provide an effective jewelry closure device which is adapted to be assembled to form a jewelry pendant.

Another object of the instant invention is to provide a jewelry closure device including outer and central elements which are adapted to be quickly and easily assembled to form a pendant.

An even further object of the instant invention is to provide a jewelry closure device which includes an outer element including a frame portion having an aperture therein and a central element which is receivable in assembled relation in the aperture.

Other objects, features and advantages of the invention shall become apparent as the description thereof proceeds when considered in connection with the accompanying illustrative drawings.

DESCRIPTION OF THE DRAWING:

In the drawing which illustrates the best mode presently contemplated for carrying out the present invention.

DESCRIPTION OF THE INVENTION

Figure 1:
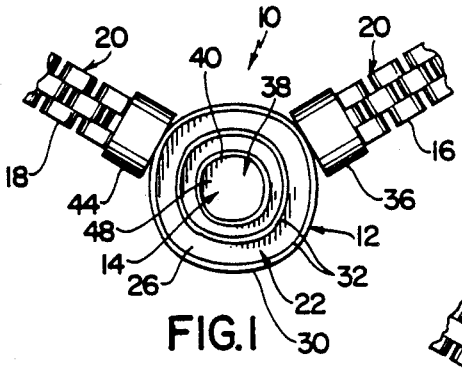
FIG. 1 is a front plan view of the closure device of the instant invention in the assembled position.
Figure 2:
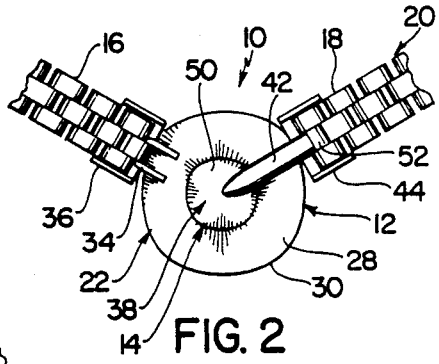
FIG. 2 is a rear plan view thereof.

Referring now to the drawing, the jewelry closure device of the instant invention is illustrated and generally indicated at 10 in FIGS. 1–6 and it comprises an outer element generally indicated at 12 and a central element generally indicated at 14. The outer element 12 and the central element 14 are attached to opposite first and second end portions 16 and 18, respectively, of a multi-link necklace chain generally indicated at 20 and they are receivable in the assembled position illustrated in FIGS. 1 and 2, wherein they cooperate to define a pendant-like structure which is operative for detachably interconnecting the first and second end portions 16 and 18.

The outer element 12 includes a frame portion generally indicated at 22 having a central aperture 24 therein and having front and rear sides 26 and 28, respectively. The frame portion 22 is preferably integrally molded from a suitable ornamental metal and, as herein embodied, the front side 26 of the frame portion 22 is of slightly convex configuration, whereas the rear side 28 is of slightly concave configuration. The frame portion 22 includes an outer peripheral edge 30 and a pair of decorative rims 32 which are formed on the front side of the frame portion 22. As herein embodied the central aperture 24 in the frame portion 22 is of slightly rounded rectangular configuration, although it will be understood that the aperture 24 could alternatively be formed in a variety of other non-circular configurations. Formed on the rear side 28 of the frame portion 22 is a slot 33 which extends outwardly from the aperture 24 to the peripheral edge 30. An attachment loop 34 is integrally formed with the frame portion 22 adjacent the peripheral edge 30 and a terminal element 36 is pivotally attached to the attachment loop 34. The first end portion 16 of the chain-like element 12 is received in engagement with the terminal element 36 for pivotally attaching the first end portion 16 to the outer element 12 in a conventional manner.

Figure 3:
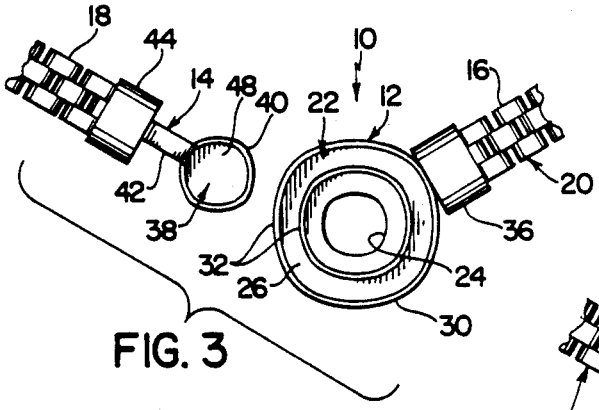
FIG. 3 is a front plan view with the closure device in a disassembled position.
Figure 4:
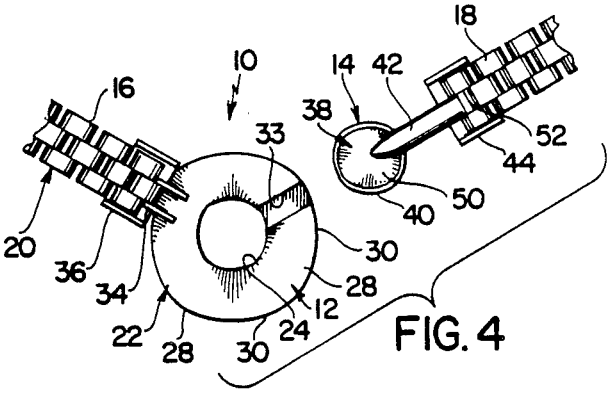
FIG. 4 is a rear plan view thereof.
Figure 5:
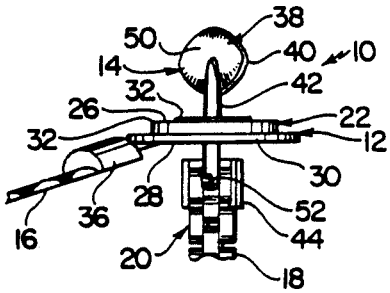
FIGS. 5 and 6 are sequential side elevational views illustrating the assembly of the central element with the outer element.
Figure 6:
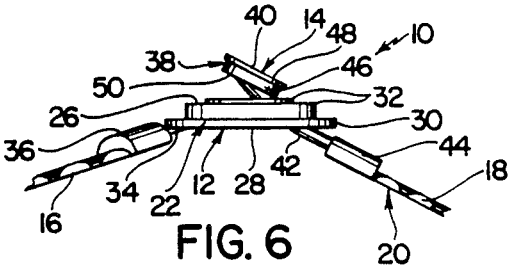

The central element 14 comprises a main body portion 38, a forward peripheral rim portion 40, a rear leg 42 and a terminal engagement member 44 on the leg 42. The main body portion 38 has a peripheral edge 46 and front and rear sides 48 and 50, respectively. The peripheral configuration and dimension of the main body portion 38 as defined by the peripheral edge 46 is substantially the same as that of the aperture 24 to enable the main body portion 46 to be received in substantially aligned relation in the aperture 24. The peripheral rim portion 40 projects outwardly from the peripheral edge 46 adjacent the front side 48 of the main body portion 38 and it substantially encircles the main body portion 38. The peripheral rim 40 is constructed and positioned so that it is engagable with the front side 26 of the frame portion 22 around the perimeter of the aperture 24 when the main body portion 38 is received in engagement in the aperture 24. The rear leg 42 extends outwardly from the rear side 50 of the main body portion 38 and it is positioned and dimensioned so that it is receivable in engagement in the slot 33 to retain the main body portion 38 in substantially aligned relation in the aperture 24. The terminal engagement member 44 is preferably integrally molded on the outer end of the leg 42 and it includes a tongue 52 which is adapted to be bent around one of the links in the second end portion 18 of the chain 20 in order to pivotally secure the second end portion 18 to the terminal engagement member 44. As illustrated in FIGS. 1 and 3, the terminal engagement member 44 is further adapted and positioned so that it engages with the peripheral edge 30 of the frame portion 22 when the main body portion 38 is received in aligned relation in the aperture 24 and the leg 42 is received in engagement in the slot 33 in order to further retain the central and outer elements 14 and 12, respectively, in assembled relation.

For use and operation of the closure device 10 the central element 14 is assembled with the outer element 12 by passing the body and rim portions 38 and 40, respectively, forwardly through the aperture 24 from the rear side 28 of the frame portion 22. This is accomplished by positioning the central element 14 so that the body portion 38 is in a generally diagonal relation in the aperture 24 and then advancing the body and rim portions 38 and 40, respectively, forwardly through the aperture 24. Thereafter, the body and the rim portions 38 and 40, respectively, are oriented so that the body portion 38 is substantially aligned with the aperture 24 and so that the leg 42 is aligned with the slot 33. The central element 14 is then moved rearwardly so that the peripheral rim 40 engages the front side 26 of the frame portion 22 adjacent the perimeter of the aperture 24 in order to prevent the body portion 38 from passing rearwardly through the aperture 24. Further, as the body portion 38 is assembled in the aperture 24 in this manner the leg 42 is positioned in the slot 33 and the terminal engagement member 44 is moved forwardly so that it is received in engagement with the peripheral edge 30. Once the central element 14 has been assembled with the outer element 12, the peripheral rim 40 prevents the body portion 38 from passing rearwardly through the aperture 24 and it also conceals the aperture 24. In addition, the leg 42 which is received in engagement in the slot 33 further prevents the body portion 38 from being inadvertently disassembled from the frame portion 22 and the terminal engagement member 44 which is received in engagement with the peripheral edge 30 further prevents the body portion 38 from being inadvertently disassembled from the frame portion 22. Further, because the body portion 38 can only be passed through the non-circular aperture 24 when the body portion 38 and the rim portion 40 are in substantially diagonal orientations in the aperture 24, the central element 14 is retained in engagement with the outer element 12 even if the body portion 38 is inadvertently partially disassembled from the aperture 24.

It is seen therefore that the instant invention provides an effective closure member for necklaces, bracelets, and the like. In this regard, the closure device 10 includes an outer element 12 and a central element 14 which are adapted to be simply and easily assembled to form an attractive pendant-like structure. Further, the rim portion 40, the leg 42 and the terminal engagement member 44 are adapted so that they cooperate to retain the central element 14 in assembled relation with the outer element 12 in order to avoid inadvertent disassembly of the central element 14 from the outer element 12. Accordingly, it is seen that the closure device of the instant invention represents a significant advancement in the jewelry art which has substantial commercial significance.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A jewelry closure device for securing opposite first and second end portions of a chain-like jewelry item comprising an outer element and a central element, said outer element including a frame portion having front and rear sides and having an open unobstructed aperture therein of non-circular configuration which extends between the front and rear sides of said outer element, and means for securing said outer element to the first end portion of said jewelry item, said central element including a body portion having front and rear sides and a peripheral edge, said body portion as defined by said peripheral edge being of the same configuration and substantially the same dimension as said aperture, said central element further including a front rim portion projecting outwardly beyond said peripheral edge adjacent the front side of said body portion, and means on the rear side of said body portion for securing said central element to the second end portion of said jewelry item, said aperture and said central element being configured to permit the passage of said central element in a forward direction through said aperture when said central element is in a predetermined non-aligned angular orientation relative thereto, said central element being receivable in an assembled position in said outer element wherein said body portion is received in aligned relation in said aperture and said rim portion engages the front side of said frame portion to prevent the passage of said central element in a rearward direction through said aperture.

2. In the closure device of claim 1, said rim portion extending substantially entirely around the periphery of said body portion.

3. In the closure device of claim 1, said frame portion having an outwardly extending slot formed in the rear side thereof, said means for securing said central element including an outwardly extending leg on the rear side of said body portion, said leg being positioned so that it is received in said slot when said central element is received in the assembled position.

4. In the closure device of claim 3, said frame portion having a peripheral edge, said means for securing said body portion to said second end including means on said leg for engaging said frame portion peripheral edge to retain said central element in the assembled position thereof.

5. In the closure device of claim 1, said frame portion having a peripheral edge, said means for securing said body portion to said second end portion including means for engaging said frame portion peripheral edge to retain said central element in the assembled position.

* * * * *